US005187882A

United States Patent [19]

Leach

[11] Patent Number: 5,187,882

[45] Date of Patent: Feb. 23, 1993

[54] SYSTEM FOR CURING CONCRETE ARTICLES

[75] Inventor: Christopher B. Leach, Deceased, Audrey A. Leach, Representative, both of Lowell, Mich.

[73] Assignee: Cam Sales, Inc., Ludington, Mich.

[21] Appl. No.: 837,039

[22] Filed: Feb. 18, 1992

Related U.S. Application Data

[63] Continuation of Ser. No. 312,118, Feb. 17, 1989, Pat. No. 5,089,198.

[51] Int. Cl.[5] ..... F26B 21/06

[52] U.S. Cl. ..... 34/46; 34/26; 34/30; 34/50; 34/48; 264/82; 264/DIG. 43; 264/40.6; 264/333

[58] Field of Search ..... 34/26, 46, 48, 50, 223, 34/104, 30, 32; 264/82, DIG. 43, 333, 234, 345, DIG. 59, 228, 71, 86, 40.1, 40.6

[56] References Cited

U.S. PATENT DOCUMENTS

| | | | |
|---|---|---|---|
| Re. 7,084 | 4/1876 | Rowland . | |
| 123,732 | 2/1872 | Schillinger . | |
| 128,980 | 7/1872 | Rowland . | |
| 137,322 | 4/1873 | Rowland . | |
| 200,064 | 2/1878 | Johnson . | |
| 683,337 | 9/1901 | Schulthess | 264/345 |
| 809,053 | 1/1906 | Gordon . | |
| 1,348,775 | 8/1920 | Bellonby | 264/82 |
| 1,379,204 | 5/1921 | Norton | 264/82 |
| 2,622,303 | 12/1952 | Wilson . | |
| 3,231,657 | 1/1966 | Kalousek | 264/345 |
| 3,238,279 | 3/1966 | Tarlton et al. . | |
| 3,275,724 | 9/1966 | Klingel | 264/345 |
| 3,327,032 | 6/1967 | Adams | 264/345 |
| 3,427,009 | 2/1969 | Shute . | |
| 3,447,937 | 6/1969 | Hersey et al. | 264/345 |
| 3,492,385 | 1/1970 | Simunic | 264/345 |
| 3,499,069 | 3/1970 | Seigle | 264/234 |
| 3,523,997 | 8/1970 | Hennig | 264/345 |
| 3,535,407 | 10/1970 | Pike | 264/82 X |
| 3,806,571 | 4/1974 | Rönnmark et al. . | |
| 3,957,937 | 5/1976 | Lovell . | |
| 4,042,659 | 8/1977 | Botting et al. | 264/71 |
| 4,069,283 | 1/1978 | Rauchfuss . | |
| 4,099,337 | 7/1978 | Wauhop, Jr. . | |
| 4,108,933 | 8/1978 | Göransson et al. . | |
| 4,244,904 | 1/1981 | Drain . | |
| 4,337,033 | 6/1982 | Drain . | |
| 4,394,335 | 7/1983 | Roth et al. | 264/82 |
| 4,427,610 | 1/1984 | Murray . | |
| 4,436,498 | 3/1984 | Murray . | |
| 4,531,304 | 7/1985 | Wauhop, Jr. et al. | 264/82 X |
| 4,599,211 | 7/1986 | Wise et al. . | |
| 4,655,979 | 4/1987 | Nakano et al. | 264/DIG. 59 X |
| 4,772,439 | 9/1988 | Trevino-Gonzalez | 264/40.1 X |

FOREIGN PATENT DOCUMENTS

| | | | |
|---|---|---|---|
| 1011608 | 4/1983 | U.S.S.R. | 264/345 |
| 1143736 | 3/1985 | U.S.S.R. | 264/345 |

*Primary Examiner*—Henry A. Bennet
*Assistant Examiner*—Denise L. F. Gromada
*Attorney, Agent, or Firm*—Waters & Morse

[57] ABSTRACT

A process is disclosed for fast and uniform hydration of uncured concrete products. Pressurized and superheated water is supplied to a manifold supporting a plurality of small diameter orifice nozzles housed inside a curing room which also houses the products during curing. Water is ejected by the nozzles in very fine particulate form, creating a mist or suspension of superheated water particles that surrounds the products and creates the desired high humidity, moderately high temperature environment for promoting hydration. The water preferably is softened before it is pressurized and supplied to the nozzles. Under favorable conditions, the hydration reaction supplies sufficient heat to maintain a desired temperature within the curing room, eliminating the need to heat the water before it is supplied to the nozzles.

4 Claims, 1 Drawing Sheet

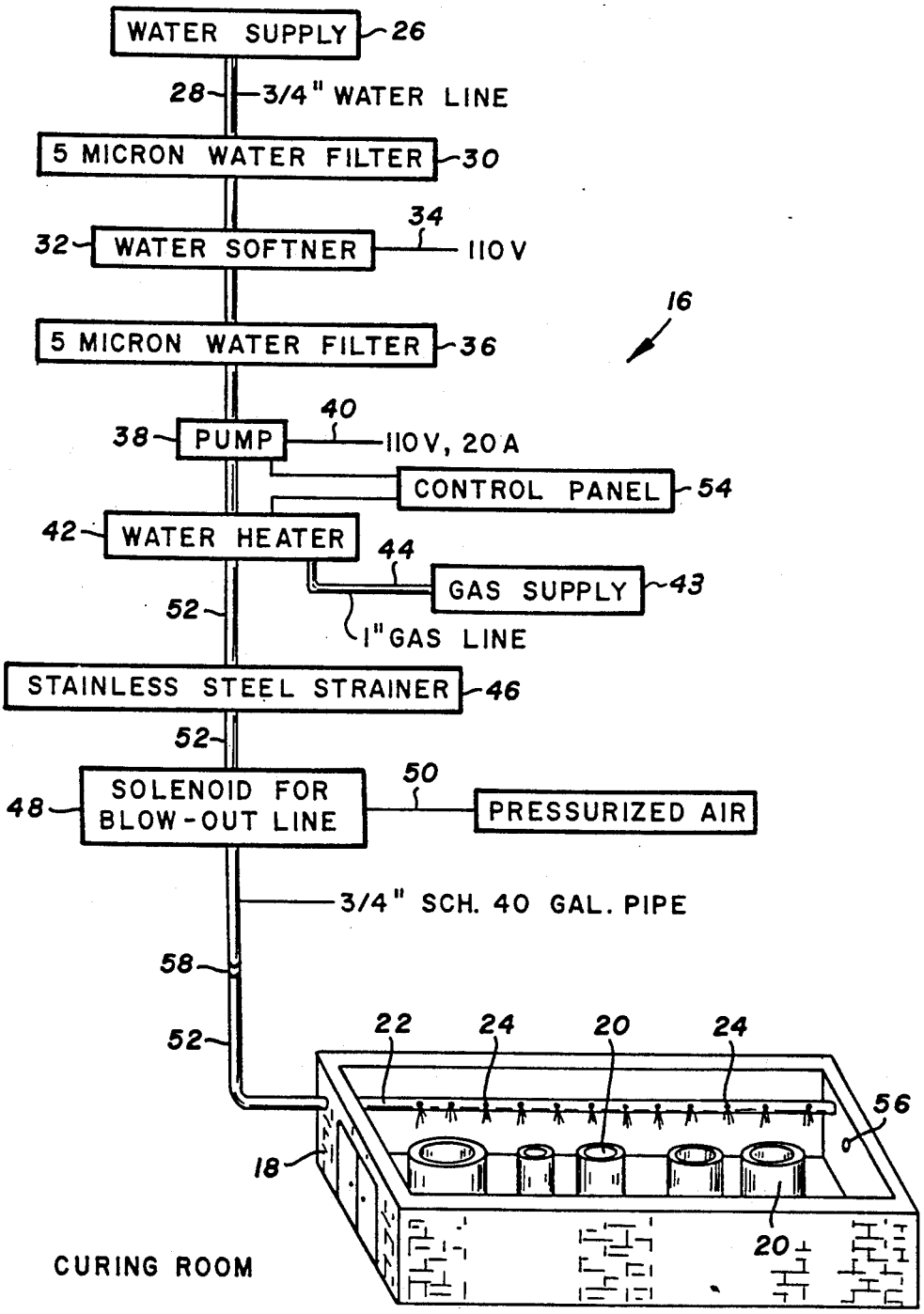
WATER SUPPLY
26
28
3/4" WATER LINE
5 MICRON WATER FILTER
30
32
WATER SOFTNER
34
110V
16
5 MICRON WATER FILTER
36
38
PUMP
40
110V, 20A
CONTROL PANEL
54
42
WATER HEATER
44
GAS SUPPLY
43
52
1" GAS LINE
STAINLESS STEEL STRAINER
46
52
48
SOLENOID FOR BLOW-OUT LINE
50
PRESSURIZED AIR
3/4" SCH. 40 GAL. PIPE
58
52
22
24
20
24
56
18
20
CURING ROOM

SYSTEM FOR CURING CONCRETE ARTICLES

CROSS REFERENCE TO RELATED APPLICATION

This is a continuation of application Ser. No. 312,118, filed Feb. 17, 1989, now U.S. Pat. No. 5,089,198.

BACKGROUND OF THE INVENTION

This invention relates to the curing of concrete products, and more particularly to promoting hydration of such products in temperature-controlled, high humidity environments.

Over the years, a number of approaches have been developed for promoting or advancing the curing of concrete products such as piping, slabs, blocks and the like. One common method of curing is to confine concrete products in a totally enclosed room or kiln, and to inject low pressure steam into the kiln from a boiler or steam generator. U.S. Pat. No. 2,622,303 (Wilson) discloses a method for molding double-walled hollow concrete blocks in which nozzles at opposite ends of a mold inject steam into the mold. A multi-stage process is disclosed in U.S. Pat. No. 3,238,279 (Tarlton), including a stage of applying steam alone into a kiln, followed by a mixture of steam and carbon dioxide, and finally a dry air stage.

It also is known to subject the concrete to, steam at high pressure. For example, U.S. Pat. No. 3,957,937 (Lovell) discloses a concrete curing method including subjecting products to superheated steam and carbon dioxide, followed by applications of steam alone, ambient air and cooling air.

Yet another approach involves providing a large trough or body of water at or near the floor of the curing enclosure. In a kiln for curing concrete slabs, U.S. Pat. No. 4,099,337 (Wauhop) shows water being sprayed into a water bath from above, but also from a position below the slabs. The spray is intended to increase evaporation from the bath. U.S. Pat. No. 4,337,033 (Drain) shows a curing system in which the atmosphere inside of the kiln is withdrawn, mixed with a stream of heated water, then injected into a body of water inside the kiln.

All of the above-described methods have a similar objective, namely to supply moisture and raise the ambient temperature of a curing enclosure sufficiently to promote the hydration process. Hydration is an exothermic chemical reaction of cement and water which hardens or solidifies the concrete product during the curing cycle, with the amount of heat generated depending upon the percentage of cement in the product. While the above approaches promote hydration for more rapid curing, they fail to provide uniform and consistent curing necessary for optimum compressive strength. Moreover, systems utilizing steam generators or boilers are expensive to acquire and operate, and, due to the high temperatures involved, subject concrete articles to crusting, baking and hot spotting problems. Bath or trough systems depend upon water vapor and require constant recirculation and heating of the water, and the attendant expensive equipment.

Therefore, it is an object of the present invention to provide a system for curing concrete products at low temperatures compared to steam-based systems and without the use of steam or carbon dioxide.

Another object of the invention is to provide a process for the rapid and uniform curing of concrete articles.

Another object is to provide a low cost system for curing concrete articles in a moderately high temperature atmosphere at or near 100% relative humidity to promote uniform hydration throughout the articles.

Yet another object is to provide a curing process in which, given favorable ambient conditions, the majority of the curing process can be accomplished without providing auxiliary heat.

SUMMARY OF THE INVENTION

To achieve these and other objects, there is provided a process for promoting the hydration of concrete articles including the steps of:

confining an uncured article of concrete in a curing enclosure;

providing a mist surrounding the article and inside the enclosure, with the mist consisting of water in the form of particles within a range of from about 20 microns to about 40 microns in diameter;

maintaining the mist within the enclosure, and simultaneously maintaining the temperature inside the enclosure in a range of from about 80° F. to about 130° F., for a predetermined period of time.

The mist can be formed by providing water at high pressure, e.g., 200–400 pounds per square inch, to a plurality of small diameter orifice nozzles inside of the curing enclosure. The water is atomized as it is ejected from the nozzles, thus to form the mist. For controlling the temperature within the curing enclosure, the pressurized water can be superheated, e.g. to a temperature of 270° F.–300° F., before it is provided to the nozzles. Superheating also enhances the tendency of the particles to form a suspension or "float", such that the mist particles eventually displace cooler air within the chamber and form a high humidity environment at a temperature sufficiently high to facilitate hydration.

At the same time, the temperature in the chamber is kept low, i.e. well below the 150° F. typical in curing operations utilizing steam. This enhances even, uniform curing throughout the products, as well as avoiding crusting, baking and similar problems associated with higher temperature curing. A further advantage of the lower temperature curing, in this case typically about 110°, is that if ambient temperatures are at least 80°, the hydration reaction can supply the necessary heat to maintain the desired curing chamber temperature. The practical effect is to eliminate the need for a water heater or other auxiliary source of heat for all except the initial stages of the curing cycle.

A further advantageous step in the process is to soften the water prior to pressurization and heating This removes potentially corrosive minerals for longer life and more efficient operation.

A concrete curing system in accordance with the present invention can be provided at a substantially reduced cost compared to conventional systems, as it requires no steam generator or boiler, but rather a water softener, a positive displacement pump and a water heater, all of which are commercially available and comparatively inexpensive. Further, all of these elements can be located outside of the curing room and thus not subject to the high humidity and potentially corrosive atmosphere within the enclosure. Operating costs, as well, are substantially lower as the atomized or particle form of superheated water can provide the necessary high humidity and temperature-controlled environment more efficiently than steam. Also, given the lower typical curing temperature, the water heating equipment can be operated intermittently, and in some cases discontinued entirely for a major portion of the curing cycle.

IN THE DRAWING

For a further appreciation of the above and other features and advantages, reference is made to the drawing figure schematically illustrating a concrete curing system constructed in accordance with the present invention.

DETAILED DESCRIPTION OF THE PREFERRED EMBODIMENT

Turning now to the drawings, there is shown a concrete curing system 16 including a generally fluid-tight room or enclosure 18 of an appropriate size to house a group of concrete piping sections 20 ready for hydration or curing, a horizontal length of piping or manifold 22 supporting a series of symmetrically spaced apart nozzles 24 and a water supply system for conditioning water and then supplying it to the nozzles.

The water supply system is connected to a water supply 26, which can be a well, a city water supply system, or the like. Water from supply 26 travels along piping 28 and through a 5 micron water filter 30 to a water softener 32. Water softener 32 can be a standard, commercially available water softener, using standard softening salt. In the preferred embodiment, the water softener is a 45,000 grain unit and is re-charged typically on a daily basis, or after one or two curing cycles. An electrical line 34 supplies power to the water softener at, typically, 110 volts. The water is softened in order to remove minerals and prevent deposits from forming on downstream piping and equipment, particularly the water heater coil. Further, the softening promotes hydration by facilitating the ability of the water to permeate the concrete piping.

Water from softener 32 is provided through a 5 micron filter 36 to a constant velocity positive displacement pump 38. An electrical line 40 provides 20 amperes of current at 110 volts. Pump 38 provides water to a flow-through water heater 42 in which natural gas provided over a line 44, to heat the water. Heated water proceeds to a stainless steel strainer 46 which can be of a size ranging from 50 mesh (openings typically 0.011 inches) to 400 mesh (0.0015 inch openings), for a final straining or cleaning of the water, whereupon it is provided at elevated temperature and pressure to manifold 22 and nozzles 24. Between the strainer and manifold, a solenoid controlled safety release or blow-out line 48, operable through an air line 50, is provided to relieve the water pressure should it exceed a predetermined maximum limit.

Piping 52 between water heater 42 and manifold 22 is preferably a Schedule 40 wrought steel galvanized piping or equivalent. The "standard strength" rated version of this piping has a working pressure of 1078 pounds per square inch, which is about 1/10th of the burst strength for a ⅜ inch diameter piping. Preferably the piping is provided in diameters of ⅓ to ½ of an inch. Manifold 22 is likewise formed of Schedule 40 galvanized piping.

In the arrangement shown, curing room 18 has a length of 140 feet, a width of 11 feet and is 12 feet high. In accordance with the curing room size, twelve nozzles 24 are provided, with adjacent nozzles spaced apart from one another a distance of 10 feet and 9 inches. Each of the nozzles is a small orifice diameter type, in particular with an orifice diameter of 0.026 inches which results in a flow rate of 0.22 gallons per minute at a pressure of 200 pounds per square inch. The nozzle size as well as the number of nozzles in the arrangement can of course be selected in accordance with the number of BTU's per hour required in the curing cycle and the size of the curing room.

The nozzle size, however, must be such as to result in the water being atomized as it is ejected, to form a mist or suspension of fine particles In particular, it has been found advantageous to provide a mist of particles having diameters in the range of from 20 to 40 microns, and the aforementioned orifice size is well suited to this end.

Pump 38, water heater 42 and pressure release solenoid 48 are operated through a control panel 54 which receives input from a temperature sensing means 56 in curing room 16 and a pressure sensor 58 along piping 52.

In the typical curing cycle, cold (unheated) water from supply 26 is softened to remove iron and other unwanted mineral elements, then provided to pump 38 which raises the pressure of the water to 200 to 400 pounds per square inch. Water is provided to water heater 42 and nozzles 24 substantially at the elevated pressure, there being no intermediate back pressure valves as the back pressure is due to the nozzles. Because of the heat added by water heater 46 and the work performed on the water by the pump, the water temperature rises to between 275° F. and 300° F., and thus the water is superheated as it exits the nozzles into the curing room. An advantage of the present invention resides in the fact that superheating the water to about 300° requires little energy compared to the conventional boiler or steam generator approach, because the water does not experience a change in phase.

Strainer 46 traps any debris which might otherwise clog delivery nozzles 24. The water proceeds along piping 52 to manifold 22, and any additional manifolds provided along other walls of the curing room, depending upon the room size and the heat or BTU requirements.

The hot, pressurized water is ejected from nozzles 24 in the form of fine particles, 20 to 40 microns in diameter. Together the particles form a suspension or mist which gradually displaces cooler air within curing room 18 as it surrounds and permeates concrete piping sections 20, providing the necessary humidity and temperature to initiate hydration. In particular, the mist or suspension is at or near 100% relative humidity and hydration can begin at from 70° F. to 80° F. Once hydration begins, the reaction itself generates additional heat which contributes to reaching and maintaining a desired temperature in the curing room. In connection with the present system, the curing room temperature preferably is maintained at 110 or above, which is adequate for uniform curing throughout the concrete piping sections. At the same time, the curing room temperature is kept well below the typical steam curing temperature of 150°, e.g. below 130° F., to avoid the baking or crusting problems encountered in steam curing.

The curing cycle proceeds at temperatures within the desired range through temperature sensing means 56 and control panel 54. In particular, the operation of water heater 42 can be discontinued responsive to the sensing of a preferred maximum curing room temperature, then be initiated again in response to the sensing of a preferred minimum temperature. In fact, for a curing cycle conducted where the ambient temperature is at least 80°, the hydration reaction alone may supply sufficient heat so that water heater 42 is not operated. Even in warm climates, however, it is preferable to begin the curing cycle with the water heater operating and to continue so for the first one or two hours in order to accelerate the hydration process. After this initial phase, the water heater is not operated since no auxiliary heat is required. It should be noted that heating of the water is required, even for an ambient temperature of 80°, if the concrete parts being cured have a cement content of about 8% of less.

The typical curing process can take from about 9 to 13 hours, including an initial phase of 7 to 10 hours in which a heated mist is continually applied, and a second phase of 2 to 3 hours in which a "cold" or unheated mist is applied. At the end of the cycle, concrete piping sections 20 or other concrete products are sufficiently cured for handling, although of course the hydration process continues at a much slower rate for years after this initial curing.

One advantage of the present curing system is a substantially lower cost as compared to conventional systems based on steam. For example, the above-described cycle requires approximately, 1,200 gallons of water, while a conventional steam boiler of e.g. 100 horse power consumes about 1,200 gallons of water per hour, for a consumption of 7,200 to 12,000 gallons in a typical 7 to 10 hour curing cycle. Further, the present system consumes less than ⅓ of the energy consumed in a steam generator or boiler system in a typical hour of operation. In addition to the lower cost, the cycle based on superheated water suspension can operate effectively at substantially lower temperatures, to promote more uniform curing throughout the piping for enhanced strength, while avoiding hot spots, baking and crusting.

With the exception of the manifold and nozzles, all of the water handling and supply equipment is located outside of the curing room, thus protecting it from the high humidity and moderately high temperature curing room environment. Thus, a rapid, uniform curing of concrete products is achieved at substantially reduced system acquisition and system operating cost.

What is claimed is:

1. Apparatus for maintaining a desirable humidity and temperature in an atmospheric pressure enclosure for curing concrete products comprising:

pump means for receiving water from a water source and discharging the water through an outlet under an elevated pressure;

nozzle means having an outlet in communication with the interior of the enclosure, the nozzle means receiving the pressurized water and producing a fine spray of water particles in the enclosure, the water pressure and nozzle means size being such that the spray is sufficiently fine to create a fine mist of water particles in the enclosure that surrounds the articles being cured;

piping means for conveying the pressurized water from the outlet of the pump means to the nozzle means;

heater means connected in the piping means between the pump means and nozzle means for heating the water while under pressure to a temperature above the atmospheric boiling point of the water, the temperature and pressure being such that the water is maintained in its liquid state while it is maintained under the pressure; and automatic control means responsive to the temperature in the enclosure for operating the heating means to the extent necessary to maintain a selected temperature range in the enclosure that is conducive to concrete curing.

2. Apparatus according to claim 1, wherein the pump means pumps water to the nozzle means at a pressure of at least about 200 pounds per square inch and the nozzle produces a fine spray comprising water particles about 40 microns in diameter or less.

3. Apparatus according to claim 2, wherein the water heater heats the water to about 275° F. or hotter and the automatic control means maintains the temperature of the atmosphere surrounding the concrete products in the enclosure at a temperature of less than about 150° F. but high enough to permit hydration to occur.

4. Apparatus according to claim 2, wherein the control means regulates the operation of the heater means to produces a curing temperature in the enclosure of about 80° F. to about 130° F.

* * * * *